US011590630B2

(12) United States Patent
Suzuki

(10) Patent No.: US 11,590,630 B2
(45) Date of Patent: Feb. 28, 2023

(54) WORKPIECE GRINDING METHOD

(71) Applicant: DISCO CORPORATION, Tokyo (JP)

(72) Inventor: Yoshikazu Suzuki, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 157 days.

(21) Appl. No.: 17/347,765

(22) Filed: Jun. 15, 2021

(65) Prior Publication Data

US 2022/0016741 A1 Jan. 20, 2022

(30) Foreign Application Priority Data

Jul. 16, 2020 (JP) ..... JP2020-121899

(51) Int. Cl.
*B24B 47/20* (2006.01)
*B24B 27/00* (2006.01)

(52) U.S. Cl.
CPC ..... *B24B 47/20* (2013.01); *B24B 27/0046* (2013.01); *B24B 27/0076* (2013.01)

(58) Field of Classification Search
CPC . B24B 47/20; B24B 27/0046; B24B 27/0076; B24B 7/228; B24B 37/04; B24B 37/07; B24B 37/10; B24B 37/11; B24B 37/12; B24B 37/16; B24B 37/34
USPC ..... 451/11
See application file for complete search history.

(56) References Cited

U.S. PATENT DOCUMENTS 6,966,826 B2 * 11/2005 Suzuki ..... B24B 7/228 451/450
7,022,000 B2 * 4/2006 Mizomoto ..... B24B 37/345 451/65
7,527,547 B2 * 5/2009 Kajiyama ..... H01L 21/67092 451/63
7,758,402 B2 * 7/2010 Yoshida ..... B24B 7/228 438/959
7,892,072 B2 * 2/2011 Lee ..... B24B 7/228 451/63
9,649,775 B2 * 5/2017 Kumazawa ..... B23K 26/40
10,112,285 B2 * 10/2018 Fujiya ..... B24B 55/02
2022/0324082 A1 * 10/2022 Suzuki ..... B24B 7/228
2022/0344163 A1 * 10/2022 Suzuki ..... B24B 7/22

FOREIGN PATENT DOCUMENTS

JP 2009090389 A 4/1996

* cited by examiner

*Primary Examiner* — Don M Anderson
*Assistant Examiner* — Jason Khalil Hawkins
(74) *Attorney, Agent, or Firm* — Greer Burns & Crain Ltd.

(57) ABSTRACT

A workpiece grinding method includes a groove formation step, a groove removal step, and a full surface grinding step. In the groove formation step, the workpiece is ground by performing grinding feed of a grinding unit while rotating a spindle without rotation of a chuck table, so that an arcuate groove is formed with a depth not reaching a finish thickness on a side of a back surface of the workpiece. In the groove removal step, rotation of the chuck table is started with the spindle kept rotating, so that the groove is ground at side walls thereof and is removed from the workpiece. In the full surface grinding step, grinding feed of the grinding unit is performed while the spindle and chuck table are rotated, so that the workpiece is ground in an entirety thereof on the side of the back surface until the workpiece has the finish thickness.

2 Claims, 7 Drawing Sheets

WORKPIECE GRINDING METHOD

BACKGROUND OF THE INVENTION

Field of the Invention

The present invention relates to a workpiece grinding method for grinding, with a grinding wheel, a workpiece held on a chuck table.

Description of the Related Art

In a manufacturing process of device chips, devices, such as an integrated circuit (IC) or large scale integration (LSI), are formed in regions of a wafer. These regions are defined by a plurality of intersecting lines (hereinafter called "the streets"). By dividing the wafer along the streets, a plurality of device chips each including the devices are manufactured. Such device chips are incorporated in various kinds of electronic equipment such as mobile phones and personal computers. In recent years, there is a growing demand for thinner device chips as a reflection of a move toward downsizing of electronic equipment. A method is hence used to thin a wafer by applying grinding to the wafer before dividing it. For the grinding of the wafer, a grinding machine including a chuck table that holds the wafer under suction and a grinding unit that grinds the wafer is used. In the grinding unit, there is disposed a grinding wheel that has a plurality of grinding stones arranged in an annular pattern.

These grinding stones are formed by fixing abrasive grits made of diamond or the like with a binder (bonding material). When grinding the wafer, the grinding stones are brought into contact with the wafer while the chuck table and grinding wheel are rotated with the wafer held under suction on the chuck table (see, for example, Japanese Patent Laid-open No. 2009-90389). Abrasive grits that project from the binder of the grinding stones come into contact with the wafer, whereby the wafer is ground. The abrasive grits are thus desired to remain in an adequately projecting state from the binder during the grinding. When the binder is abraded by processing debris and the like generated in the grinding, the binder located at acting surfaces that are facing the wafer, in surfaces of the grinding stones, is dug out. With a decrease of the binder, abrasive grits fall off from the binder. When the grinding is further continued after the fall-off of the abrasive grits, fresh abrasive grits are exposed from the binder due to wearing of the binder (self-sharpening). Due to this self-sharpening, the state that abrasive grits project from the binder is maintained, thereby preventing the grinding stones from being lowered in grinding capability.

SUMMARY OF THE INVENTION

Depending on the material of a wafer, the material of a ground surface of the wafer, and the like, however, the fall-off timing of abrasive grits may be advanced. If a relatively hard oxide film is formed on the ground surface, for example, fall-off (shedding) of abrasive grits is prone to occur. In such a case, a longer period of time is needed from the fall-off of abrasive grits until completion of self-sharpening, in other words, a workpiece is ground for a longer period of time in a state that grinding stones have a low grinding capability, so that a processing failure tends to take place. With the foregoing problem in view, the present invention thus has as an object thereof the provision of a wafer grinding method that can suppress the occurrence of a processing failure.

In accordance with an aspect of the present invention, there is provided a workpiece grinding method for grinding a workpiece with use of a grinding machine including a chuck table that holds the workpiece; and a grinding unit that has a spindle and a grinding wheel disposed on the spindle, the grinding wheel having a plurality of grinding stones arranged in an annular pattern, and that grinds the workpiece held on the chuck table with the grinding wheel kept rotating about the spindle. The workpiece grinding method includes a groove formation step of grinding the workpiece by performing grinding feed of the grinding unit while rotating the spindle without rotation of the chuck table on which the workpiece is held, so that an arcuate groove is formed with a depth not reaching a finish thickness of the workpiece on a side of a back surface of the workpiece, a groove removal step of, after the groove formation step, starting rotation of the chuck table with the spindle kept rotating, so that the groove is ground at side walls thereof and is removed from the workpiece, and a full surface grinding step of, after the groove removal step, performing grinding feed of the grinding unit while rotating the spindle and the chuck table, so that the workpiece is ground in an entirety thereof on the side of the back surface until the workpiece has the finish thickness.

In the groove removal step, the chuck table may preferably be rotated while grinding feed of the grinding unit is performed.

The workpiece grinding method according to the aspect of the present invention includes the groove formation step of forming the arcuate groove in the workpiece by rotating the spindle without rotation of the chuck table, the groove removal step of grinding the groove at the side walls of the workpiece and removing the groove by starting rotation of the chuck table with the spindle kept rotating, and the full surface grinding step of grinding the workpiece in an entirety thereof on the side of the back surface thereof. In the groove formation step, the grinding is performed primarily with bottom surfaces of the grinding stones. In the groove removal step, on the other hand, the grinding can be performed primarily with side surfaces of the grinding stones. It is thus possible in the groove removal step to reduce deteriorations of conditions of the bottom surfaces of the grinding stones (in other words, lowering of the grinding capability) compared with a case in which the workpiece is ground in its entirety on the side of its back surface primarily with the bottom surfaces of the grinding stones. In the full surface grinding step after the groove removal step, the workpiece from which the groove has been removed is ground in its entirety on the side of its back surface. In this full surface grinding step, the grinding is performed primarily with the bottom surfaces of the grinding stones, especially in a state that the bottom surfaces of the grinding stones are in conditions of less deteriorations. The occurrence of a processing failure of the workpiece can hence be suppressed even if a relatively hard oxide film is formed on the side of the back surface.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

Figure 1:
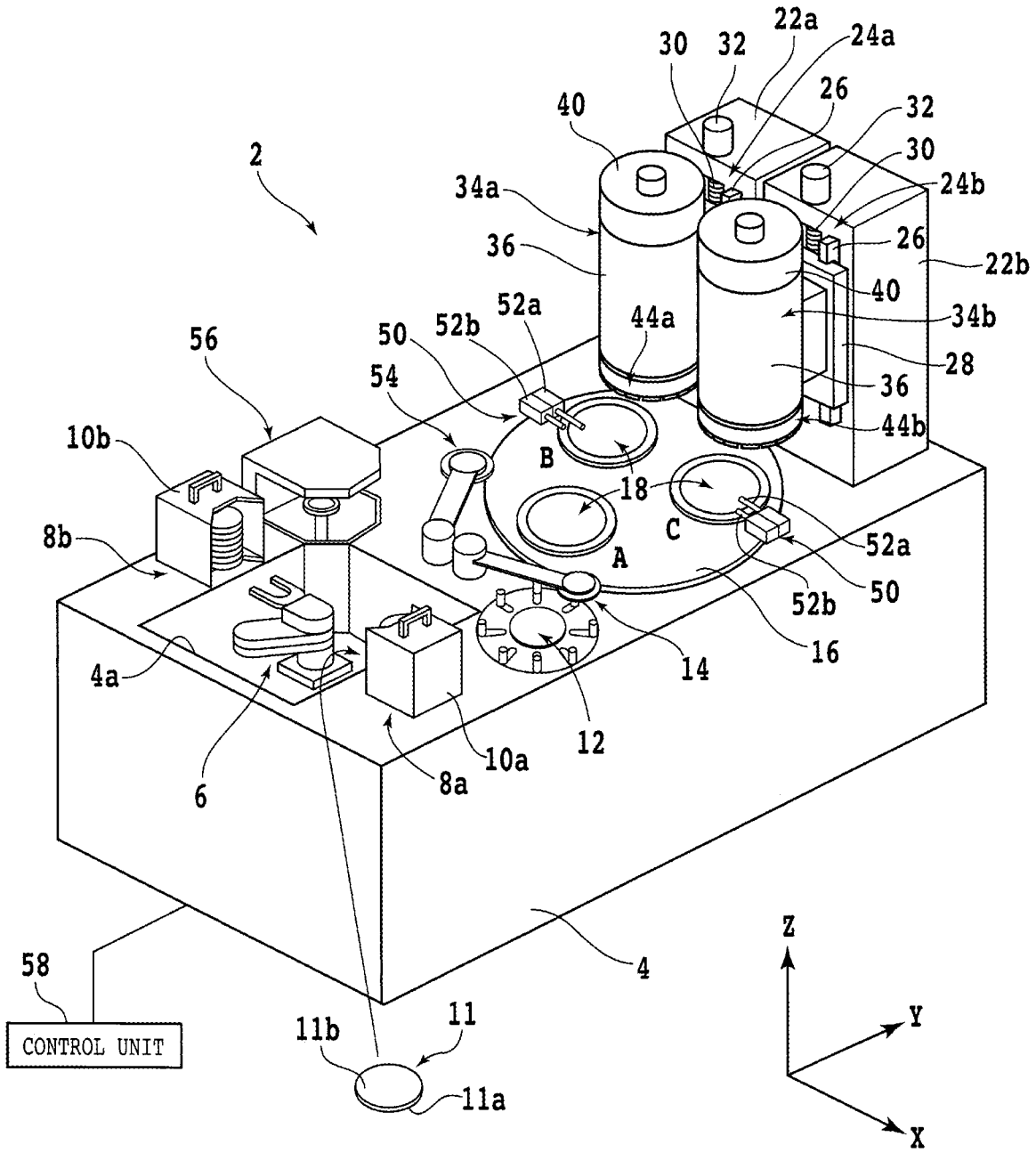
FIG. 1 is a perspective view of a grinding machine that can perform a workpiece grinding method according to an embodiment of the aspect of the present invention.

With reference to the attached drawings, an embodiment of the aspect of the present invention will hereinafter be described. A description will first be made about a configuration example of a grinding machine 2 that can perform the grinding method of this embodiment for a workpiece 11. FIG. 1 is a perspective view depicting the grinding machine 2. In the following description, an X-axis direction (left-right direction), a Y-axis direction (front-rear direction), and a Z-axis direction (grinding feed direction, up-down direction, height direction) intersect one another at right angles. Further, some elements of the grinding machine 2 are illustrated by functional blocks in some of the attached drawings.

The grinding machine 2 includes a bed 4 that supports or accommodates individual elements. The bed 4 is provided, on a side of an upper surface of a front end section thereof, with a rectangular opening 4*a*. In the opening 4*a*, a horizontal articulated robot arm (first transfer unit) 6 is disposed to transfer the workpiece 11. The robot arm 6 is provided, on opposite ends thereof in the X-axis direction, with cassette mount regions 8*a* and 8*b*, respectively. On the cassette mount regions 8*a* and 8*b*, cassettes 10*a* and 10*b* with workpieces 11 accommodated therein are arranged, respectively.

In the cassette 10*a*, a plurality of workpieces 11 before grinding are accommodated. In the cassette 10*b*, on the other hand, a plurality of workpieces 11 after grinding are accommodated. Each workpiece 11 is a disc-shaped silicon wafer having a predetermined diameter (for example, a diameter of approximately 200 mm). The workpiece 11 has a front surface 11*a* and a back surface 11*b*. The workpiece 11 has a thickness (a length from the front surface 11*a* to the back surface 11*b*) of a predetermined value that is 200 μm or greater but 800 μm or smaller (for example, 725 μm), and on a side of the back surface 11*b*, a thermal oxide film is formed with a thickness ranging from 2,000 Å to 3,000 Å.

On the front surface 11*a*, a plurality of streets are set in a grid pattern. Rectangular regions defined by the streets include devices such as ICs or LSI formed respectively on a side of the front surface 11*a*. It is to be noted that no limitations are imposed on the kind, material, size, shape, structure, and the like of the workpiece 11. The workpiece 11 may be a wafer or substrate formed of a material other than silicon, such as a compound semiconductor (gallium nitride (GaN), silicon carbide (SiC) or the like), glass, ceramic, resin, metal, or the like. Further, no limitations are imposed on the kind, number, shape, structure, size, arrangement, and the like of the devices formed on the workpiece 11. Furthermore, no devices may be formed on the workpiece 11.

In rear of the opening 4*a* on one side in the X-axis direction, a position matching mechanism 12 is disposed. The workpiece 11 accommodated in the cassette 10*a* is transferred to the position matching mechanism 12 by the robot arm 6, and is positioned at a predetermined location by the position matching mechanism 12. At a location adjacent to the position matching mechanism 12 on the other side in the X-axis direction, a loading arm (second transfer unit) 14 is disposed to transfer the workpiece 11. The loading arm 14 includes, at a distal end portion thereof, a suction pad that holds the workpiece 11 under suction on the side of the back surface 11*b* thereof.

The loading arm 14 holds, with the suction pad, the workpiece 11 positionally matched by the position matching mechanism 12, and then causes the suction pad to turn about an axis of rotation located at a proximal end portion of the loading arm 14, thereby transferring the workpiece 11 to a loading/unloading station A. In rear of the loading arm 14, a disc-shaped turn table 16 is disposed. To a lower portion of the turn table 16, a rotational drive source (not depicted) such as a motor is connected. The turn table 16 is rotated by the rotational drive source about an axis of rotation that is substantially parallel to the Z-axis direction.

On the turn table 16, three chuck tables 18 which can each hold the workpiece 11 are arranged at substantially equal intervals along a peripheral direction of the turn table 16. Through rotation of the turn table 16, each chuck table 18 is sequentially positioned at the loading/unloading station A, a coarse grinding station B, and a finish grinding station C. For example, one of the chuck tables 18, the one chuck table 18 being positioned at the loading/unloading station A, is positioned at the coarse grinding station B by rotation of the turn table 16 clockwise over approximately 120 degrees in a top plan view.

By further rotating the turn table 16 clockwise over approximately 120 degrees in the top plan view, the chuck table 18 is next positioned at the finish grinding station C. Thereafter, by further rotating the turn table 16 counterclockwise over approximately 240 degrees in the top plan view, the chuck table 18 is then positioned from the finish grinding station C to the loading/unloading station A. A rotational drive source 20 (see, for example, FIG. 2A) such as a motor is connected, via an output shaft thereof, to a lower portion of each chuck table 18. The rotational drive source 20 rotates the chuck table 18 about an axis of rotation that is substantially parallel to the Z-axis direction.

In rear of the coarse grinding station B, a columnar support structure 22*a* is arranged. In rear of the finish grinding station C, on the other hand, a columnar support structure 22*b* is arranged. On a side of a front surface of the support structure 22*a*, a grinding feed unit 24*a* is arranged. On a side of a front surface of the support structure 22*b*, on the other hand, a grinding feed unit 24*b* is arranged. The grinding feed units 24*a* and 24*b* each include a pair of guide rails 26 arranged substantially parallel to the Z-axis direction. On the paired guide rails 26, a movable plate 28 is arranged in a state that it is slidable along the guide rails 26.

On a side of a rear surface of the movable plate 28, nut portions (not depicted) are disposed. To the nut portions, a ball screw 30 arranged substantially parallel to the guide rails 26 is rotatably connected. To an upper end portion of the ball screw 30, a stepping motor 32 is connected. When the ball screw 30 is rotated by the stepping motor 32, the movable plate 28 moves along the Z-axis direction. On a side of a front surface of the movable plate 28 of the grinding feed unit 24*a*, a grinding unit 34*a* is fixed to perform coarse grinding of the workpiece 11. On a side of a front surface of the movable plate 28 of the grinding feed unit 24*b*, on the other hand, a grinding unit 34*b* is fixed to perform finish grinding of the workpiece 11. The grinding feed units 24*a* and 24*b* respectively move the grinding units 34*a* and 34*b* up and down.

Figure 2A:
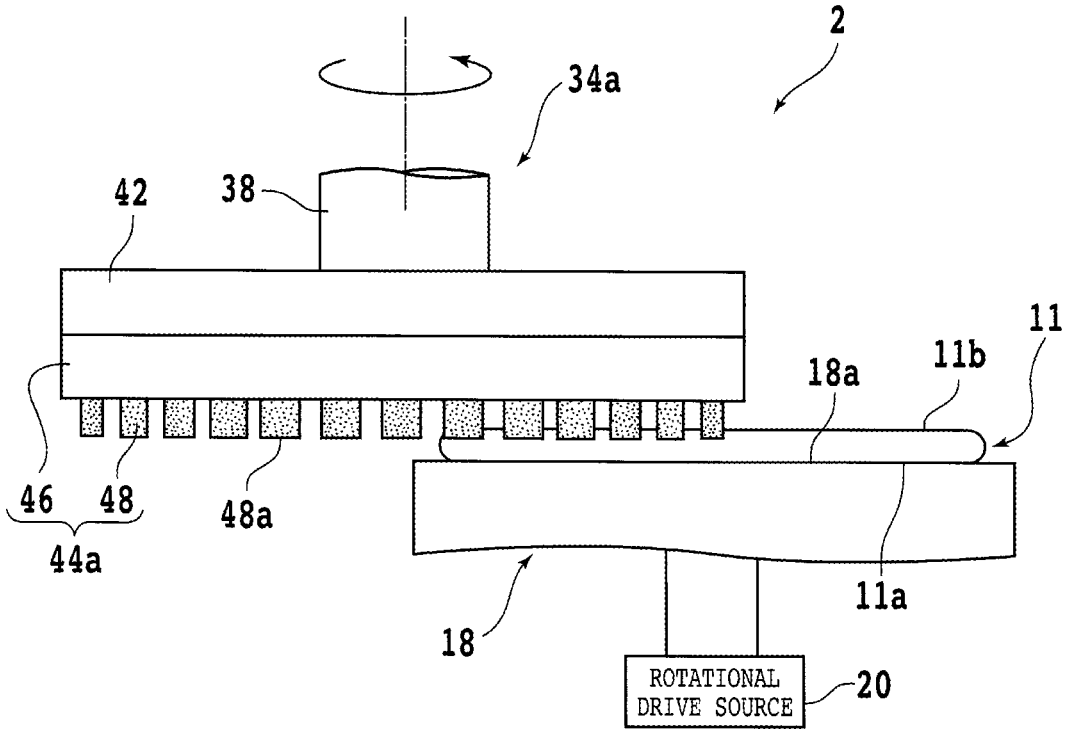
FIG. 2A is a side view of a workpiece, a chuck table, and a grinding wheel, and illustrates a groove formation step in the workpiece grinding method.

The grinding units 34*a* and 34*b* each have a cylindrical housing 36. Inside the housing 36, a portion of a cylindrical spindle 38 (see FIG. 2A) disposed along the Z-axis direction is accommodated. On an upper end portion of the spindle 38, a rotational drive source 40 such as a motor is arranged to rotate the spindle 38. As illustrated in FIG. 2A, a lower end portion of the spindle 38 is exposed from the housing 36, and on the lower end portion, a disc-shaped mount 42 is fixed at a central area of an upper surface thereof.

Figure 2B:
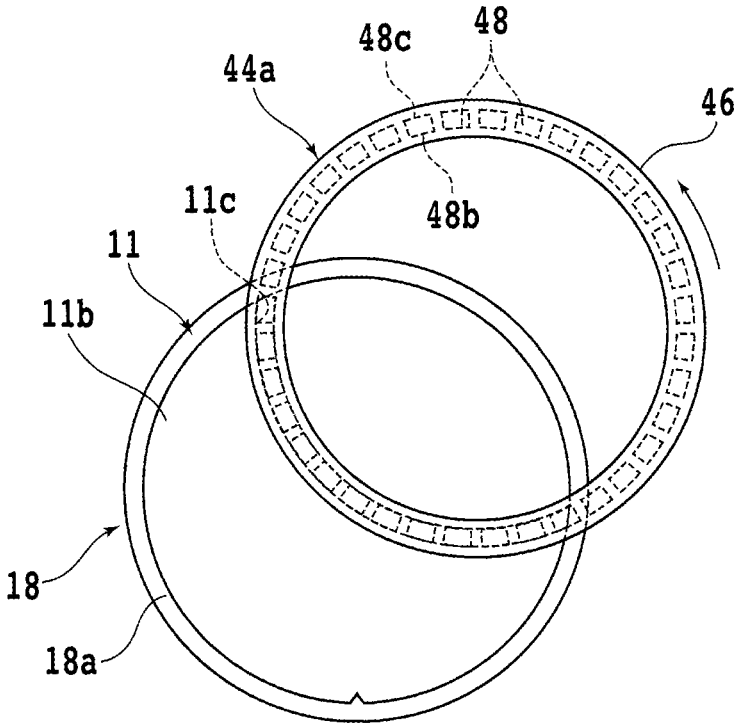
FIG. 2B is a top plan view of the workpiece, the chuck table, and the grinding wheel, and illustrates the groove formation step.

On a side of a lower surface of the mount 42 of the grinding unit 34*a*, a grinding wheel 44*a* for coarse grinding is disposed. The grinding wheel 44*a* includes an annular hub 46 having substantially the same diameter as the mount 42. On a side of a lower surface of the annular hub 46, a plurality of grinding stones 48 are discretely arranged along a peripheral direction of the annular hub 46. As illustrated in FIG. 2B, the grinding stones 48 are thus arranged in an annular pattern on the side of the lower surface of the annular hub 46. Each of the grinding stones 48 has a substantially parallelepipedal shape, and are formed by fixing abrasive grits, which are formed of diamond, cubic boron nitride (cBN), or the like, with metal, resin, vitrified, or like binder.

Each chuck table 18 has a disc-shaped frame body formed of a ceramic material. In an upper portion of the frame body, a disc-shaped recess is formed, and in this disc-shaped recess, a disc-shaped porous plate made of a porous ceramic material is fixed. The porous plate is connected to a suction source (not illustrated) such as an ejector via a flow passage (not illustrated) formed inside the frame body. An upper surface of the porous plate and an upper surface of the frame body are substantially in flush with each other, and make up a holding surface 18*a* on which the workpiece 11 is to be held under suction.

The holding surface 18*a* has a conical shape that slightly expands from an outer periphery toward a center. For the sake of convenience, however, the holding surface 18*a* is illustrated as a planar surface substantially parallel to the X-axis direction and Y-axis direction in FIG. 2A (also in FIGS. 4A and 5 to be described later) because the amount of expansion of the holding surface 18*a* is extremely small (for example, 30 μm). When the suction source is operated and a negative pressure is caused to act on the upper surface of the porous plate, the workpiece 11 or the like arranged on the holding surface 18*a* is held under suction on the holding surface 18*a* so that the workpiece 11 or the like conforms to the shape of the holding surface 18*a*. It is to be noted that the axis of rotation of the chuck table 18 is slightly inclined relative to the Z-axis direction so that a grinding surface that is defined by the lower surfaces of the grinding stones 48 and a portion of the holding surface 18*a* become substantially parallel to each other. For the sake of convenience, however, the axis of rotation of the chuck table 18 is illustrated to be substantially parallel to the Z-axis direction in FIG. 2A (also in FIGS. 4A and 5 to be described below) because the axis of rotation has an extremely small inclination.

The grinding wheel 44*a* is arranged above the chuck table 18 positioned at the coarse grinding station B, and partly covers an upper surface of the chuck table 18 so that a portion of the grinding wheel 44*a* passes above the center of rotation of the chuck table 18 (see FIG. 2B). The grinding unit 34*b* depicted in FIG. 1 is configured similar to the grinding unit 34*a*. On a side of a lower surface of the mount 42 of the grinding unit 34*b*, a grinding wheel 44*b* for finish grinding is disposed. The grinding wheel 44*b* has a similar configuration as the grinding wheel 44*a*, but the abrasive grits contained in the grinding stones 48 of the grinding wheel 44*b* have an average grit size smaller than that of the abrasive grits contained in the grinding stones 48 of the grinding wheel 44*a*.

The grinding units 34*a* and 34*b* are each provided internally or externally with a grinding water supply unit (not illustrated) for supplying fluid (grinding fluid) such as pure water to a processing point. In the vicinity of each of the coarse grinding station B and finish grinding station C, a thickness gauge 50 is arranged. The thickness gauge 50 includes a first height gauge 52*a* and a second height gauge 52*b*. The first height gauge 52*a* measures the height of the upper surface (in other words, the back surface 11*b*) of the workpiece 11 held under suction on the corresponding chuck table 18, and the second height gauge 52*b* measures the height of the holding surface 18*a*. Based on a difference between the heights measured by the first height gauge 52*a* and the second height gauge 52*b*, the thickness of the workpiece 11 is calculated. On the other side in the X-axis direction of the loading arm 14, an unloading arm (third transfer unit) 54 is disposed.

The unloading arm 54 includes a suction pad that holds the workpiece 11 under suction on the side of the back surface 11*b* thereof. After holding, with the suction pad, the workpiece 11 positioned at the loading/unloading station A, the unloading arm 54 causes the suction pad to turn about an axis of rotation located at a proximal end portion of the loading arm 54, thereby transferring the workpiece 11 to a cleaning unit 56. After cleaning the workpiece 11 by the cleaning unit 56, the workpiece 11 is transferred by the robot arm 6, and is accommodated in the cassette 10*b*. The grinding machine 2 has a control unit 58 that controls operations of the individual elements.

The control unit 58 controls operations of the robot arm 6, the position matching mechanism 12, the loading arm 14, the turn table 16, the chuck tables 18, the rotational drive sources 20, the grinding feed units 24*a* and 24*b*, the grinding units 34*a* and 34*b*, the thickness gauges 50, the unloading arm 54, the cleaning unit 56, and so on. The control unit 58 is configured by a computer that includes, for example, a processor (processing device) represented by a central processing unit (CPU), a main storage device such as a dynamic random access memory (DRAM), a static random access memory (SRAM), and a read only memory (ROM), and an auxiliary storage device such as a flash memory, a hard disk drive, or a solid state drive. In the auxiliary storage device, software containing predetermined programs is stored. Functions of the control unit 58 are realized by operating the processing device and the like according to the software. A description will next be made about a grinding method of the workpiece 11, in which the workpiece 11 is ground using the grinding machine 2.

First, the cassette 10*a* with workpieces 11 accommodated therein is arranged on the cassette mount region 8*a*, and one of the workpieces 11 is transferred by the robot arm 6 from the cassette 10*a* to the position matching mechanism 12. After position matching of the workpiece 11 has been performed by the position matching mechanism 12, the workpiece 11 is transferred by the loading arm 14 from the position matching mechanism 12 onto the chuck table 18 arranged at the loading/unloading station A.

At this time, the workpiece 11 is arranged on the chuck table 18 with the side of the back surface 11*b* being exposed upward, whereby the workpiece 11 is held under suction on the holding surface 18*a* on the side of the front surface 11*a* (see FIG. 2A). It is to be noted that, if devices are formed on the side of the front surface 11*a*, a protective tape may be bonded to the side of the front surface 11*a* in order to protect the devices. If this is the case, the side of the front surface 11*a* is held under suction on the holding surface 18*a* via the protective tape.

Next, the turn table 16 is rotated clockwise over approximately 120 degrees in the top plan view, so that the chuck table 18 with the workpiece 11 held thereon is arranged at the coarse grinding station B. Then, the workpiece 11 is coarsely ground by the grinding unit 34*a*. In this embodiment, an arcuate groove 11*c* is formed on the side of the back surface 11*b* by grinding the workpiece 11 with the grinding unit 34*a* without rotation of the chuck table 18 (groove formation step S10).

FIG. 2A is a side view of the workpiece 11, the chuck table 18, and the grinding wheel 44*a*, and illustrates the groove formation step S10. When the rotational drive source 40 is operated, the grinding wheel 44*a* rotates about the spindle 38. In the groove formation step S10, the spindle 38 is set at a predetermined rotational speed (for example, 3,500 rpm), and grinding feed of the grinding unit 34*a* is performed at a predetermined grinding feed rate (for example, 0.5 μm/sec).

When the spindle 38 is rotated and the grinding feed of the grinding unit 34*a* is performed with the grinding stones 48 maintained in contact with the side of the back surface 11*b*, the side of the back surface 11*b* is ground primarily with the bottom surfaces 48*a* of the grinding stones 48. FIG. 2B is a top plan view of the workpiece 11, the chuck table 18, and the grinding wheel 44*a*, and illustrates the groove formation step S10. In the groove formation step S10, the chuck table 18 is not rotated, so that the side of the back surface 11*b* is ground along a track of the rotating grinding stones 48 and the arcuate groove 11*c* is formed along a locus of the rotating grinding stones 48 on the side of the back surface 11*b*.

Figure 3:
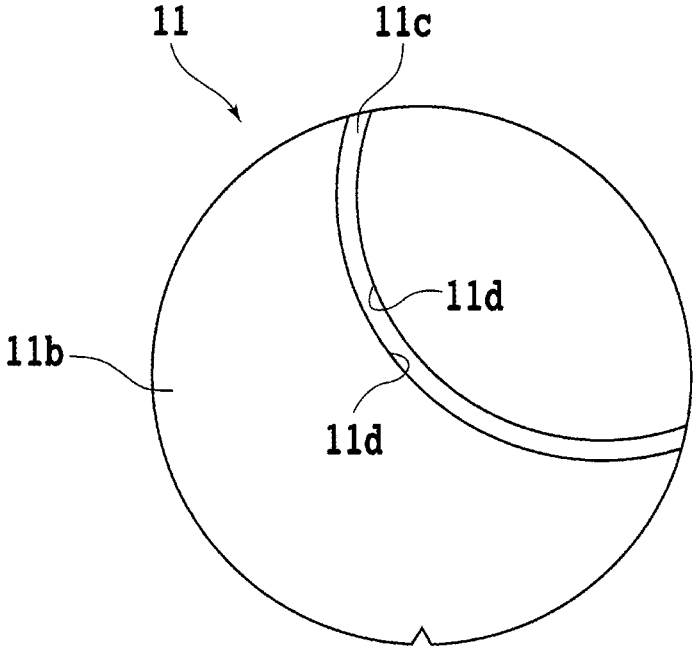
FIG. 3 is a top plan view of the workpiece after the groove formation step.

The groove 11*c* has a depth that is deeper than the thermal oxide film formed on the side of the back surface 11*b* but does not reach a finish thickness of the workpiece 11. If the thickness before grinding is 725 μm and the finish thickness is 50 μm, for example, a grinding feed amount by which the grinding unit 34*a* is to be moved downward from a height position where the grinding surfaces come into contact with the back surface 11*b* is set to 20 μm. FIG. 3 is a top plan view of the workpiece 11 obtained after the groove formation step S10. The groove 11*c* is formed in an arcuate shape that extends from a portion of an outer periphery of the workpiece 11, through a center of the back surface 11*b*, to another portion of the outer periphery of the workpiece 11. In the groove formation step S10, the bottom surfaces 48*a* of the grinding stones 48 are primarily used to form the single groove 11*c*. It is thus possible to reduce deteriorations of conditions of the bottom surfaces 48*a* of the grinding stones 48 (in other words, lowering of the grinding capability) compared with a case in which the workpiece 11 is ground in its entirety on the side of the back surface 11*b* by using primarily the bottom surfaces 48*a* of the grinding stones 48.

Figure 4A:
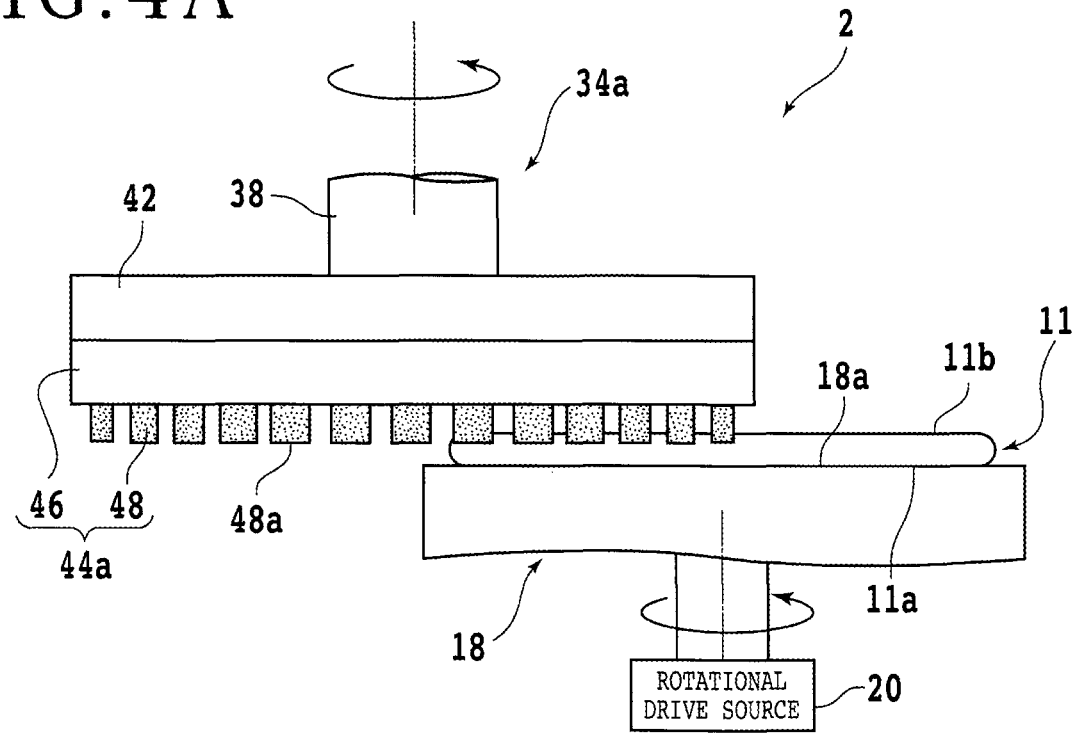
FIG. 4A is a side view of the workpiece, the chuck table, and the grinding wheel, and illustrates a groove removal step in the workpiece grinding method.
Figure 4B:
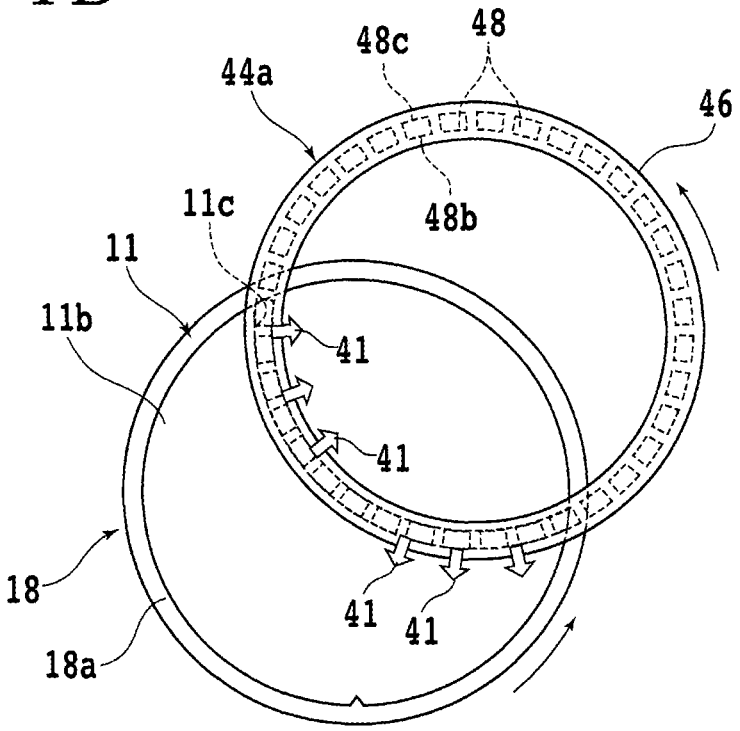
FIG. 4B is a top plan view of the workpiece, the chuck table, and the grinding wheel, and illustrates the groove removal step.

After the grinding feed of the grinding unit 34*a* has been performed by a predetermined grinding feed amount, rotation of the chuck table 18 is started with the spindle 38 kept rotating at the predetermined rotational speed. Consequently, the groove 11*c* is ground at side walls 11*d* thereof primarily with inner peripheral side surfaces 48*b* and outer peripheral side surfaces 48*c* of the grinding stones 48, and is thus removed from the side of the back surface 11*b* (groove removal step S20). FIG. 4A is a side view of the workpiece 11, the chuck table 18, and the grinding wheel 44*a*, and illustrates the groove removal step S20. FIG. 4B is a top plan view of the workpiece 11, the chuck table 18, and the grinding wheel 44*a*, and illustrates the groove removal step S20. As indicated by arrow marks 41 in FIG. 4B, the side of the back surface lib is ground primarily with the inner peripheral side surfaces 48*b* and the outer peripheral side surfaces 48*c* of the grinding stones 48 in the groove removal step S20.

As described above, the groove removal step S20 is performed right after the groove formation step S10. In the groove removal step S20, the chuck table 18 is rotated at a predetermined rotational speed (for example, 100 rpm) while grinding feed of the grinding unit 34*a* is performed at a predetermined grinding feed rate (for example, 0.5 μm/sec). In the groove removal step S20, the thermal oxide film is removed by grinding the side of the back surface 11*b* with the inner peripheral side surfaces 48*b* and the outer peripheral side surfaces 48*c* of the grinding stones 48, the inner peripheral side surfaces 48*b* and the outer peripheral side surfaces 48*c* having relatively good conditions, instead of the bottom surfaces 48*a* of the grinding stones 48, the bottom surfaces 48*a* having been primarily used in the groove formation step S10. In the groove removal step S20, it is possible to reduce the deteriorations of the conditions of the bottom surfaces 48*a* of the grinding stones 48 compared with the case in which the workpiece 11 is also ground in its entirety on the side of the back surface 11*b* with the bottom surfaces 48*a* of the grinding stones 48, the bottom surfaces 48*a* having been primarily used in the groove formation step S10.

Figure 5:
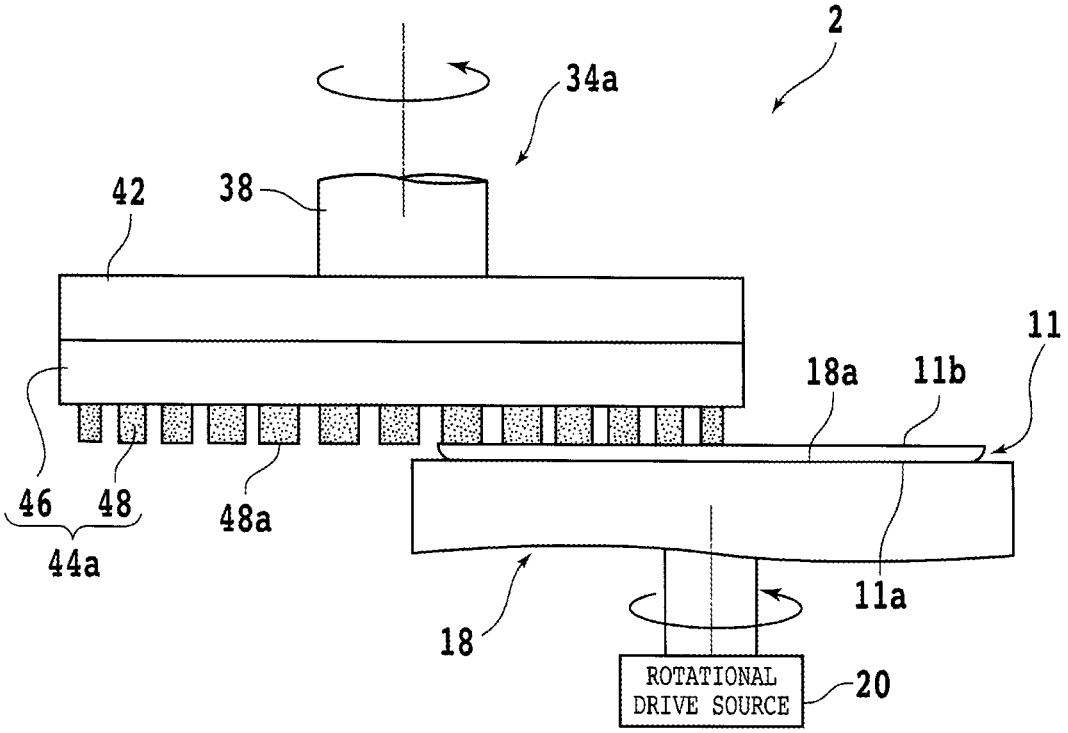
FIG. 5 is a side view of the workpiece, the chuck table, and the grinding wheel, and illustrates a full surface grinding step in the workpiece grinding method.

After the groove removal step S20, grinding feed of the grinding unit 34*a* is performed while the spindle 38 and the chuck table 18 are rotated, whereby the workpiece 11 is ground in its entirety on the side of the back surface 11*b* until the thickness of the workpiece 11 is reduced to the finish thickness (full surface grinding step S30). FIG. 5 is a side view of the workpiece 11, the chuck table 18, and the grinding wheel 44*a*, and illustrates the full surface grinding step S30. The rotational speeds of the spindle 38 and the chuck table 18 and the grinding feed rate are the same as those in the groove removal step S20.

In the full surface grinding step S30, the side of the back surface 11*b* is ground by the grinding unit 34*a* while the bottom surfaces 48*a* of the grinding stones 48 are primarily used and the thickness of the workpiece 11 is measured by the thickness gauge 50 until the workpiece 11 has a predetermined thickness greater than the finish thickness (first full surface grinding). As the workpiece 11 has been ground using primarily the inner peripheral side surfaces 48*b* and the outer peripheral side surfaces 48*c* of the grinding stones 48 in the above-mentioned groove removal step S20, the conditions of the bottom surfaces 48*a* of the grinding stones 48 have not been deteriorated much (in other words, are relatively good) in the full surface grinding step S30. Occurrence of a processing failure can thus be suppressed even if a relatively hard oxide film is formed on the side of the back surface 11*b*.

After the workpiece 11 has been thinned to the predetermined thickness by the grinding unit 34*a*, the turn table 16 is rotated to position the workpiece 11 at the finish grinding station C. Grinding is then performed by the grinding unit 34*b* while the thickness of the workpiece 11 is measured by the thickness gauge 50 (second full surface grinding). When the workpiece 11 has been thinned to the finish thickness in the second full surface grinding, the full surface grinding step S30 is ended, followed by rotation of the turn table 16 to position the workpiece 11 at the loading/unloading station A.

Figure 6:
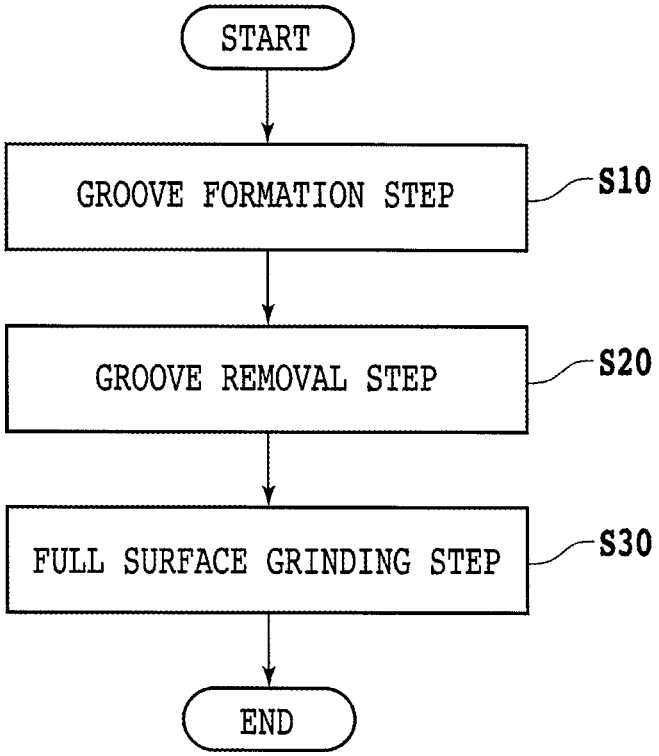
FIG. 6 is a flow diagram illustrating the workpiece grinding method.

The workpiece 11 is transferred to the cleaning unit 56 by the unloading arm 54, and the workpiece 11 cleaned by the cleaning unit 56 is transferred into the cassette 10*b* by the robot arm 6. FIG. 6 is a flow diagram illustrating the grinding method of this embodiment. As described above, the grinding method of this embodiment for the workpiece 11 includes the groove formation step S10 that forms the arcuate groove 11*c*, the groove removal step S20 that grinds the side walls 11*d* of the groove 11*c* by starting rotation of the chuck table 18 with the spindle 38 kept rotating, and the full surface grinding step S30.

In the groove formation step S10, the grinding is performed primarily with the bottom surfaces 48*a* of the grinding stones 48. In the groove removal step S20, on the other hand, the grinding can be performed primarily with the inner peripheral side surfaces 48*b* and outer peripheral side surfaces 48*c* of the grinding stones 48. Compared with the case in which the workpiece 11 is ground in its entirety on the side of the back surface 11*b* primarily with the bottom surfaces 48*a* of the grinding stones 48, the deteriorations of the conditions of the bottom surfaces 48*a* of the grinding stones 48 can thus be reduced. In the full surface grinding step S30 that performs grinding primarily with the bottom surfaces 48*a* of the grinding stones 48, occurrence of a processing failure of the workpiece 11 can be suppressed accordingly.

Figure 7:
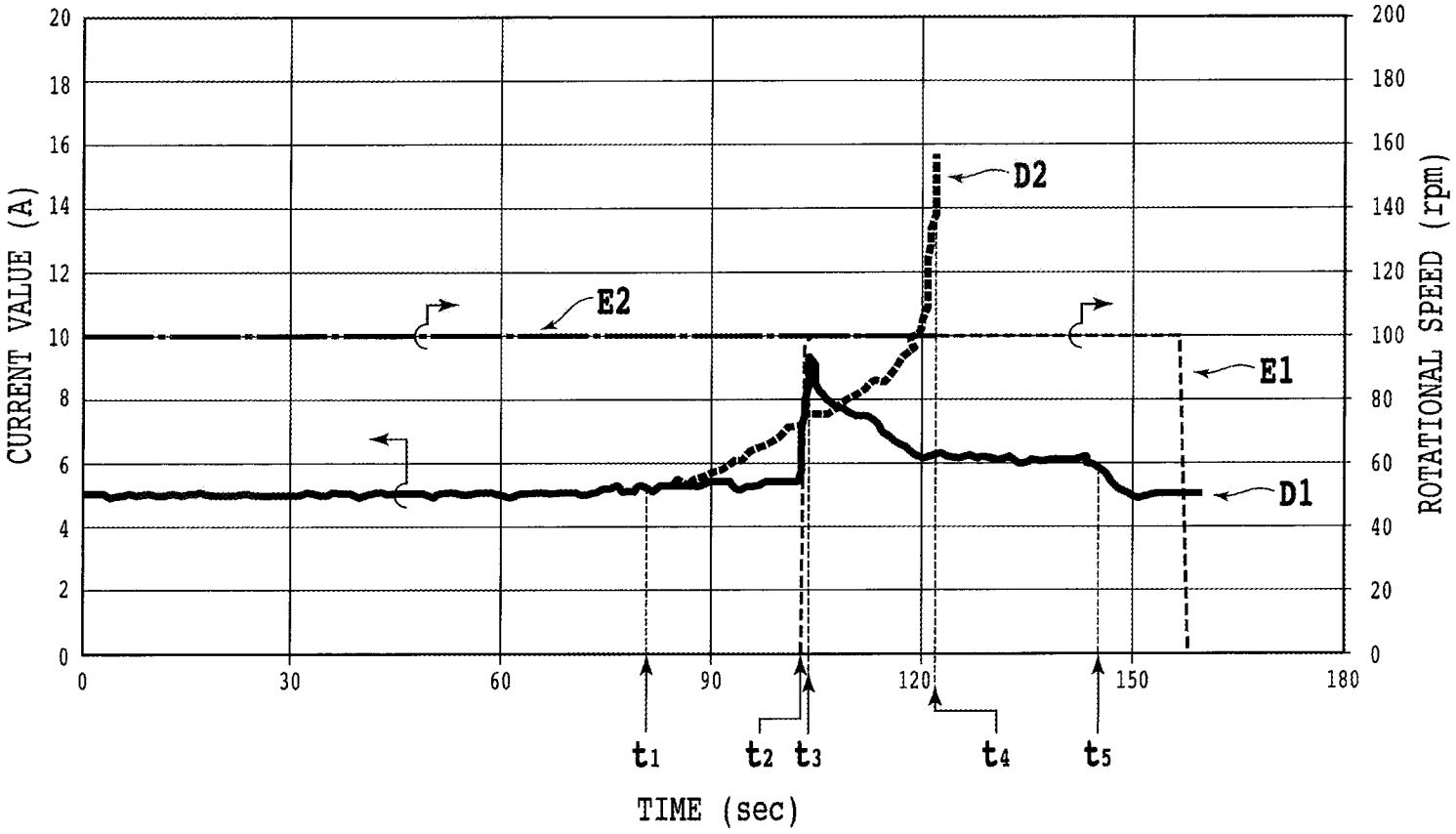
FIG. 7 is a graph depicting time-dependent changes of a current value to a motor that drives a spindle and a rotational speed of the chuck table in the workpiece grinding method.

With reference to FIG. 7, a description will next be made about an experiment in which the grinding method of this embodiment and a conventional grinding method were compared. In the experiment, silicon wafers (diameter: approx. 200 mm, thickness: approx. 725 μm) each with a thermal oxide film of approx. 2,000 Å to 3,000 Å thickness formed on the side of the back surface 11*b* were used as workpieces 11. As a grinding unit, on the other hand, the grinding unit 34*b* was used. The grinding unit 34*b* had the grinding wheel 44*b* having the grinding stones 48 in which diamond abrasive grits of grit size #3000 were fixed with a vitrified bond.

FIG. 7 presents graphs D1 (solid line) and D2 (dotted line) each illustrating time-dependent changes of the current value to the motor driving the spindle 38, and graphs E1 (broken line) and E2 (dash-dot line) each illustrating time-dependent changes of the rotational speed of the chuck table 18. In the conventional grinding method, the side of the back surface 11*b* was ground using primarily the bottom surfaces 48*a* of the grinding stones 48 from start to end without the formation of the groove 11*c*. Also, in the conventional grinding method, as illustrated by the graph E2, the rotational speed of the chuck table 18 was set constant at 100 rpm from time 0 sec to time $t_4$.

In the grinding method of this embodiment, on the other hand, as illustrated by the graph E1, the chuck table 18 was kept stationary without rotation from time 0 sec to time $t_2$ (groove formation step S10), and rotation of the chuck table 18 was started at time $t_2$ (groove removal step S20). The rotational speed was then maintained at 100 rpm until time 150 sec elapsed (full surface grinding step S30). In both the grinding method of this embodiment and the conventional grinding method, the grinding feed rate of the grinding unit 34*b* arranged above the chuck table 18 was set to 0.5 μm/sec. Also, in both the grinding method of this embodiment and the conventional grinding method, the bottom surfaces 48*a* of the grinding stones 48 were brought into contact with the back surface 11*b* at time $t_1$, to start grinding.

In the conventional grinding method, the current value gradually increased (see graph D2). At time $t_4$, the grinding feed was stopped to end the grinding. As apparent from the manner of the increase of the current value from time 120 sec to time $t_4$, a relatively high grinding load was applied to the grinding stones 48 in the conventional grinding method. In the grinding method of this embodiment, on the other hand, the groove formation step S10 was performed from time $t_1$ to time $t_2$ to form the groove 11*c* (groove formation step S10). With the spindle 38 kept rotating, rotation of the chuck table 18 was then started at time $t_2$ (groove removal step S20).

As illustrated by the graph D1, the current value increased with a spike at time $t_2$, but shortly began decreasing at time $t_3$ without reaching an allowable upper limit. This period from time $t_2$ to time $t_3$ corresponds to the groove removal step S20. The period from time $t_2$ to time $t_3$ is approx. 1 sec, and is a period of time that allows the chuck table 18 to make approximately one and a half rotations. Therefore, the groove 11*c* was removed while the chuck table 18 made approximately one and a half rotations.

The period from time $t_3$ to time $t_4$ corresponds to the full surface grinding step S30. Compared with the conventional grinding method, the conditions of the bottom surfaces 48*a* of the grinding stones 48 were relatively good in the full surface grinding step S30, so that the grinding load (in other words, the current value) was relatively low. Moreover, self-sharpening of the grinding stones 48 is considered to have effectively occurred in the full surface grinding step S30. As described above, effectiveness of the grinding method of this embodiment was confirmed in the experiment. It is to be noted that, at time $t_4$, the grinding feed was stopped to terminate the grinding. In the period from time $t_4$ to time $t_5$, the grinding stones 48 did not come into contact with the back surface 11*b* and remained in an idling state.

It is to be noted that the configuration, method, and the like of the above-described embodiment can be practiced with changes or alterations as needed to such an extent as not departing from the scope of the object of the present invention. For example, the grinding feed of the grinding unit 34*a* was performed in the groove removal step S20 in the grinding method of the above-described embodiment. However, such grinding feed may be omitted insofar as the groove 11*c* can be removed.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A workpiece grinding method for grinding a workpiece with use of a grinding machine including a chuck table that holds the workpiece and a grinding unit that has a spindle and a grinding wheel disposed on the spindle, the grinding wheel having a plurality of grinding stones arranged in an annular pattern, and that grinds the workpiece held on the chuck table with the grinding wheel kept rotating about the spindle, comprising:

a groove formation step of grinding the workpiece by performing grinding feed of the grinding unit while rotating the spindle without rotation of the chuck table on which the workpiece is held, so that an arcuate groove is formed with a depth not reaching a finish thickness of the workpiece on a side of a back surface of the workpiece;

a groove removal step of, after the groove formation step, starting rotation of the chuck table with the spindle kept rotating, so that the groove is ground at side walls thereof and is removed from the workpiece; and a full surface grinding step of, after the groove removal step, performing grinding feed of the grinding unit while rotating the spindle and the chuck table, so that the workpiece is ground in an entirety thereof on the side of the back surface until the workpiece has the finish thickness.

2. The workpiece grinding method according to claim 1, wherein, in the groove removal step, the chuck table is rotated while grinding feed of the grinding unit is performed.

* * * * *